US009025806B2

(12) United States Patent
Krissman et al.

(10) Patent No.: US 9,025,806 B2
(45) Date of Patent: May 5, 2015

(54) HEADPHONE ASSEMBLY

(71) Applicant: The Ketchum Group, Inc., Inglewood, CA (US)

(72) Inventors: Charles Krissman, Los Angeles, CA (US); Michael Craig Krisztal, Los Angeles, CA (US)

(73) Assignee: The Ketchum Group

( * ) Notice: Subject to any disclaimer, the term of this patent is extended or adjusted under 35 U.S.C. 154(b) by 167 days.

(21) Appl. No.: 13/736,800

(22) Filed: Jan. 8, 2013

(65) Prior Publication Data

US 2014/0193020 A1 Jul. 10, 2014

(51) Int. Cl.
*H04R 25/00* (2006.01)
*H04R 1/10* (2006.01)

(52) U.S. Cl.
CPC ..... *H04R 1/1058* (2013.01); *H04R 1/1008* (2013.01); *H04R 1/1041* (2013.01); *H04R 2201/023* (2013.01); *H04R 2420/07* (2013.01); *H04R 2430/01* (2013.01)

(58) Field of Classification Search
CPC .... H04R 1/1008; H04R 1/1041; H04R 5/033; H04R 2201/103
USPC ..... 381/311, 370–371, 374, 376, 384
See application file for complete search history.

(56) References Cited

U.S. PATENT DOCUMENTS

| | | | | |
|---|---|---|---|---|
| 1,628,483 | A | 5/1927 | Wiegand | |
| 1,936,273 | A | 11/1933 | Segal | |
| D194,152 | S | 11/1962 | Noyes | |
| D269,611 | S | 7/1983 | Saito | |
| D292,331 | S | 10/1987 | Bryant | |
| D305,072 | S | 12/1989 | Ferguson | |
| D323,043 | S | 1/1992 | Lofton | |
| D333,659 | S | 3/1993 | Williams | |
| D351,387 | S | 10/1994 | Roberts | |
| 5,751,825 | A | 5/1998 | Myers et al. | |
| D399,206 | S | 10/1998 | Yasutomi et al. | |
| 5,875,956 | A | 3/1999 | Benarrouch | |
| 5,881,390 | A | 3/1999 | Young | |
| D453,015 | S | 1/2002 | Yuyama | |
| D495,247 | S | 8/2004 | Keberlein | |
| 6,965,681 | B2 * | 11/2005 | Almqvist | 381/371 |
| 7,155,025 | B1 | 12/2006 | Weffer | |
| 7,395,090 | B2 | 7/2008 | Alden | |
| 7,761,091 | B2 | 7/2010 | Dunn et al. | |
| D623,627 | S | 9/2010 | Alden et al. | |
| D624,057 | S | 9/2010 | Kelly et al. | |
| 7,925,029 | B2 * | 4/2011 | Hollemans et al. | 381/74 |
| D641,003 | S | 7/2011 | Alden | |
| 8,014,824 | B2 | 9/2011 | Alden | |
| D650,356 | S | 12/2011 | Alden et al. | |
| D656,129 | S | 3/2012 | Kelly et al. | |
| D665,776 | S | 8/2012 | Alden et al. | |
| D665,777 | S | 8/2012 | Alden et al. | |
| 2002/0003889 | A1 | 1/2002 | Fischer | |

(Continued)

FOREIGN PATENT DOCUMENTS

| | | | |
|---|---|---|---|
| EP | 2160046 | A1 | 3/2010 |

*Primary Examiner* — Curtis Kuntz
*Assistant Examiner* — Ryan Robinson
(74) *Attorney, Agent, or Firm* — Tsircou Law, P.C.

(57) ABSTRACT

A headphone assembly is provided that includes two earpieces coupled by a flexible connecting wire. Each earpiece includes a single large button disposed on a distal side of the earpiece, thereby enabling a wearer to operate the system, even without direct access thereto.

18 Claims, 2 Drawing Sheets

(56) References Cited

U.S. PATENT DOCUMENTS

| | | | | |
|---|---|---|---|---|
| 2006/0147052 | A1* | 7/2006 | Wikel et al. | 381/74 |
| 2008/0058037 | A1 | 3/2008 | Dunn et al. | |
| 2008/0226112 | A1 | 9/2008 | Lin | |
| 2008/0267440 | A1 | 10/2008 | Alden | |
| 2008/0279404 | A1 | 11/2008 | Kuo | |
| 2008/0319562 | A1 | 12/2008 | Forstall | |
| 2009/0323975 | A1 | 12/2009 | Groesch | |
| 2010/0040245 | A1* | 2/2010 | Buil et al. | 381/107 |
| 2010/0245585 | A1 | 9/2010 | Fisher et al. | |
| 2011/0032071 | A1 | 2/2011 | Tondering | |
| 2011/0164776 | A1 | 7/2011 | Kelly et al. | |
| 2011/0211709 | A1* | 9/2011 | Szolga et al. | 381/74 |
| 2011/0235819 | A1 | 9/2011 | Alden | |
| 2012/0077438 | A1 | 3/2012 | Jung | |
| 2012/0128172 | A1 | 5/2012 | Alden | |
| 2012/0257775 | A1 | 10/2012 | Siskin et al. | |
| 2012/0275615 | A1 | 11/2012 | Kelly et al. | |

* cited by examiner

HEADPHONE ASSEMBLY

FIELD OF THE INVENTION

The present invention relates generally to headphones and, more particularly, to headphone assemblies mountable within separate headwear such as protective helmets, ski caps, earmuffs, headbands, among others.

BACKGROUND OF THE INVENTION

Portable media players have changed the way users incorporate music into their daily lives. Advances in portable media technology have made devices smaller and lighter, allowing users to access music and media content while engaging in nearly any activity. Improvements in media storage capacity also allow users to store and access a substantial amount of media content. In addition, increased battery capacity allows users to use devices for extended periods of time without having to recharge the device.

Furthermore, many mobile phones, such as smartphones, have media player functionality and Internet access. Users can access music that is stored on the phones or "stream" it via the Internet. Streaming allows users to continuously receive media content from a provider, much like traditional broadcast media. A user with an Internet capable smartphone has access to a virtually limitless amount of media content from any location where the phone has coverage.

It is common for people to have a mobile phone, portable media players, or both. Accordingly, many people have become accustomed to listening to music throughout the entire day, even during everyday activities such as commuting on public transportation or doing chores. Additionally, people are incorporating music into with outdoor sports and activities. For example, runners and joggers frequently listen to music as a stimulus or a distraction to improve their performance.

It has become increasingly common for people engaging in outdoor activities, particularly skiing and snowboarding, to use portable media players and mobile phones to listen to music. However, both in-ear and over-ear headphones are ill adapted for these activities.

Generally, these activities require, among other things, the use of a helmet or head covering beanie, and goggles. Winter specific headwear is typically designed to partially or completely cover the ears to protect against the cold and wind. In-ear headphones (e.g., earbuds) may cause discomfort due to the pressure exerted by the helmet, beanie, or goggle bands on against the ear. Even if the user adjusts the headgear away from or off the ears, earphones are very likely to fall out while engaging in the activity.

Generally, over-the-ear style headphones completely cover the ear and are positioned over the top of the head of the user. Therefore, a user wearing a helmet, which is commonly worn while snowboarding or skiing, will not be able to use headphones. If the user decides not to wear a helmet, headphones may be worn, but it is too cumbersome and difficult to secure on the user's head while the user is participating in the activity.

In addition, traditional headphones are inconvenient for outdoor activities because they typically connect to the media player or mobile phone by wires. The wires can be entangled with equipment, clothing, and the user's hands and become a great inconvenience to the user. In addition, wires can hinder and restrict the movement of the user's head and neck, preventing the user from safely and comfortably participating in the activity.

Moreover, it is difficult and inconvenient for a user to operate the media device or mobile phone while participating in an outdoor activity. Skiing and snowboarding require users to wear thickly padded gloves, which prevents the user from having sufficient dexterity accuracy to control the device. In addition, most of the current devices have a touchscreen interface that requires the conductivity from a person's fingertips to operate. Therefore, a user would have to remove his or her gloves to use the device. Although some earphones and headphones are equipped with a control adaptor built into the wire, the control adaptor is typically too small to be properly and accurately used while wearing gloves. Thus, there is a need for skiers and snowboarders to be able to conveniently control a media device or mobile phone while participating in the activity without having to take off their gloves.

Furthermore, using traditional headphones may pose a dangerous risk to people participating in outdoor activities. Although popular and largely enjoyed, skiing and snowboarding is an inherently dangerous activity. A skier or snowboarder should be fully aware of the surrounding environment, especially the sounds of other skiers and snowboarders nearby. Wearing traditional earphones or headphones may pose a significant risk to the user because traditional headphones are designed to block out all ambient noise. Thus, there is a need for skiers and snowboarders to be able to listen to their media player or mobile phone without having all ambient noise being blocked.

It should, therefore, be appreciate that there remains a need for headphones that can be used with protective helmets, ski caps, earmuffs, headbands, among others, particularly while participating in outdoor activities, such as skiing and snowboarding.

SUMMARY OF THE INVENTION

The invention provides headphone assembly for use with an electronic device, such as mobile phones, mp3 players, and other media devices, adapted to be held in place proximate to a wearer's ears with separate headwear, e.g., sports helmet. The headphone assembly includes two earpieces coupled by a flexible connecting wire. Each earpiece includes a single large button disposed on a distal side of the earpiece. Having a large single button on each earpiece enables wearer to operate the system through a helmet liner, even while wearing gloves, even bulky winter gloves, i.e., the button is ease to locate and operate. In this manner, the wearer can operate the system without direct access to either the headphone assembly or the wireless device.

In a detailed aspect of an exemplary embodiment, each button preferably accounts for at least 30 percent of the surface area of the distal wall and, more particularly, the buttons can account for between 40 percent and 50 percent of the surface area of the distal wall of the body. Thus, each button is easily locatable while minimizing the prospects of inadvertent use.

In another detailed aspect of an exemplary embodiment, the distal sides of both earpieces have a convex shape provided by a planar central area surrounded by a downwardly angled rim circumscribing the planar central area. The single buttons of both earpieces are each disposed on the respective central area.

In yet another detailed aspect of an exemplary embodiment, the proximal sides of both earpieces have a convex shape provided by a planar central area surrounded by a downwardly angled rim circumscribing the planar central area. The earpieces further include a sidewall disposed between the distal side and the proximal side, the sidewall having a plurality of planar segments.

In yet another detailed aspect of an exemplary embodiment, the first earpiece or the second earpiece include a wireless communication assembly and a controller to operative with a wireless device. the single button of the first earpiece controls playback of audio and the single button of the second earpiece controls volume.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
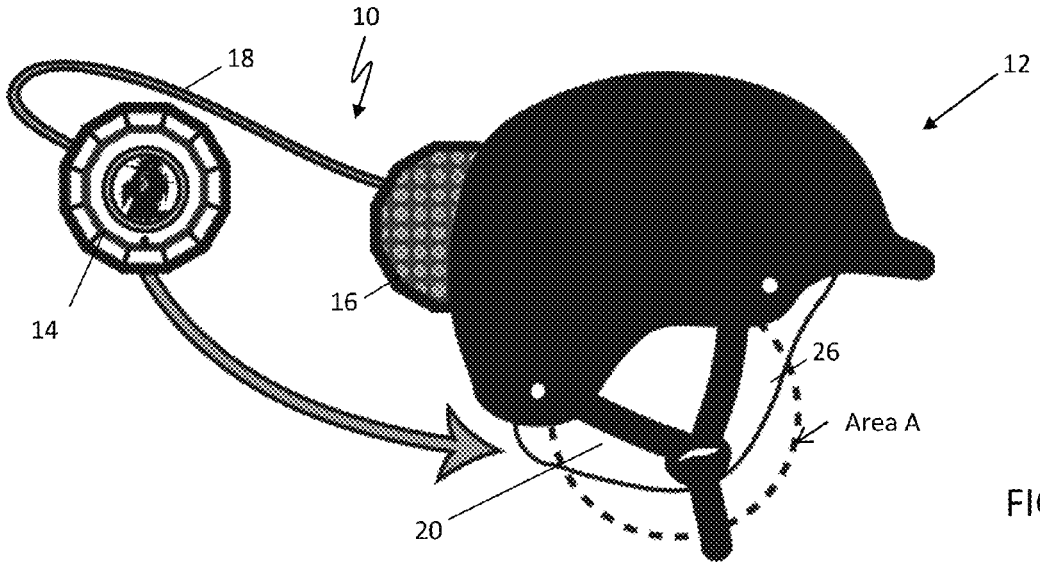
FIG. 1 is a perspective view of a headphone assembly in accordance with the invention, depicting the headphone assembly positioned adjacent to a helmet for insertion into pockets of ear covers for the helmet.

Referring now to the drawings, and particularly FIGS. 1, there is shown a wireless headphone assembly 10 for use with a wireless device 8 (FIG. 3) (such as mobile phones, mp3 players, and other media devices) and configured to be mounted within a sports helmet 12. The headphone assembly includes two earpieces 14, 16 coupled by a flexible connecting wire 18. The earpieces are sized to be received within ear covers 20 of the sports helmet. Each earpiece includes a single large button (22, 24) disposed on a distal side of the earpiece. The left button and the right button are assigned distinct functionality for operating the wireless device. In addition, the buttons are sufficiently sized so that the wearer can operate by depressing the button through the ear cover. In this manner, the wearer can operate the system without direct access to either the headphone assembly or the wireless device.

Figure 2:
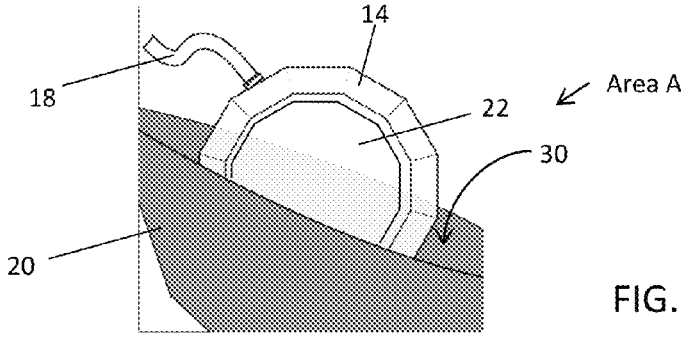
FIG. 2 is a close-up perspective view of an earpiece of the headphone assembly of FIG. 1, depicting the earpiece being inserted into a pocket of the ear cover of the helmet, the earpiece having a large single button along a distal wall of the earpiece.
Figure 3:
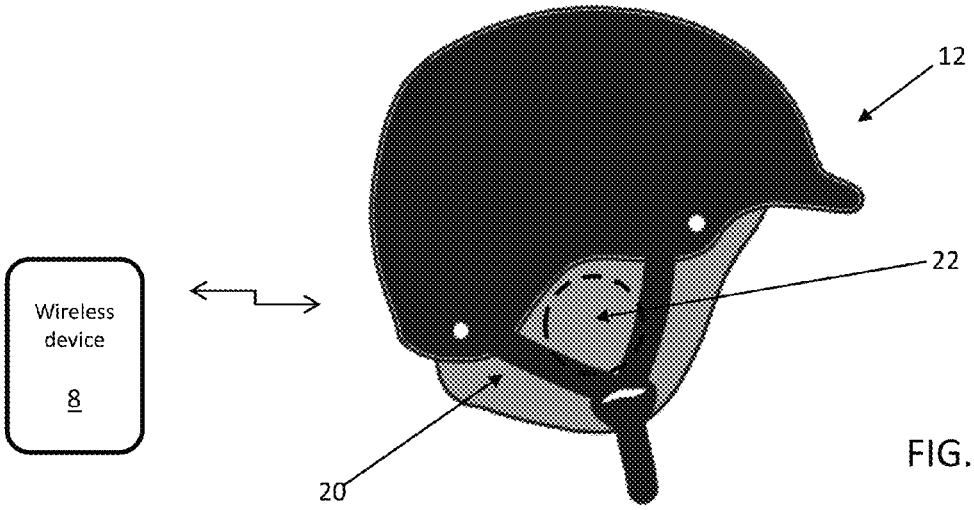
FIG. 3 is a perspective view of the helmet of FIG. 1, with the headphone assembly hidden within the ear covers, with the single button of the earpiece shown in phantom

With reference now to FIGS. 2 and 3, the headphone assembly 10 is used in conjunction with separate headwear. In the exemplary embodiment, the earpieces 14, 16 are received within the helmet liner 26 of the helmet 12. The helmet liner includes two pockets 30 positioned adjacent to the wearer's ears, in ear covers 20 defined by the helmet liner. The earpieces are uniquely size and shaped so that the wearer can readily locate them by feeling the outer surface of the helmet liner proximate to the ear. Moreover, buttons 22, 24 are sufficiently sized so that the wearer can locate and operate the buttons through the helmet liner, i.e., by pressing on the outer surface of the ear cover on the buttons.

The wearer merely needs to depress the buttons 22, 24 to control operations of the wireless device eight. Thus, the earpieces can have any rotational orientation within the pockets 30 without affecting operational control of the wireless device. In the exemplary embodiment, the button 22 for the right earpiece 14 operates play/pause functionality for the wireless device 8 and/or answer/hang-up functionality for phone calls. The button 24 for the left earpiece 16 operates volume control for the wireless device 8. A single click on the button 24 raises the volume, while a double-click on the button 24 lowers the volume. In other embodiments, various other functionalities can be operated by the buttons, as desired.

The shape of the earpieces facilitates easy insertion into the headwear. To that end, the earpieces of the headphone assembly lack over the ear attachments or in-ear attachments. In this manner, the headphone assembly can be used with any number of various headwear items, e.g., ball caps, headbands, helmets, so on, within need of such item being specially configured for use with the headphone assembly.

Figure 4:
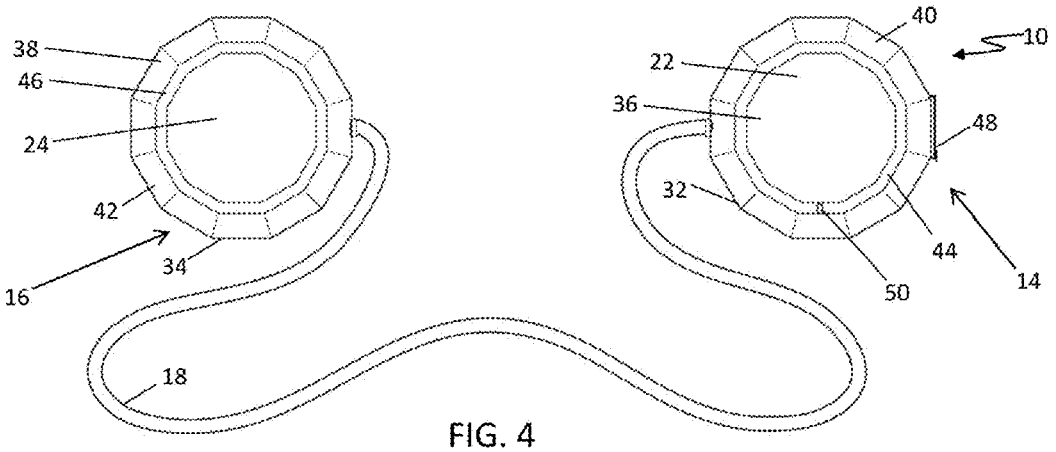
FIG. 4 is top view of the headphone assembly of FIG. 1, depicting each earpiece having a distal wall providing a large single button surrounded by an angled rim.
Figure 5:
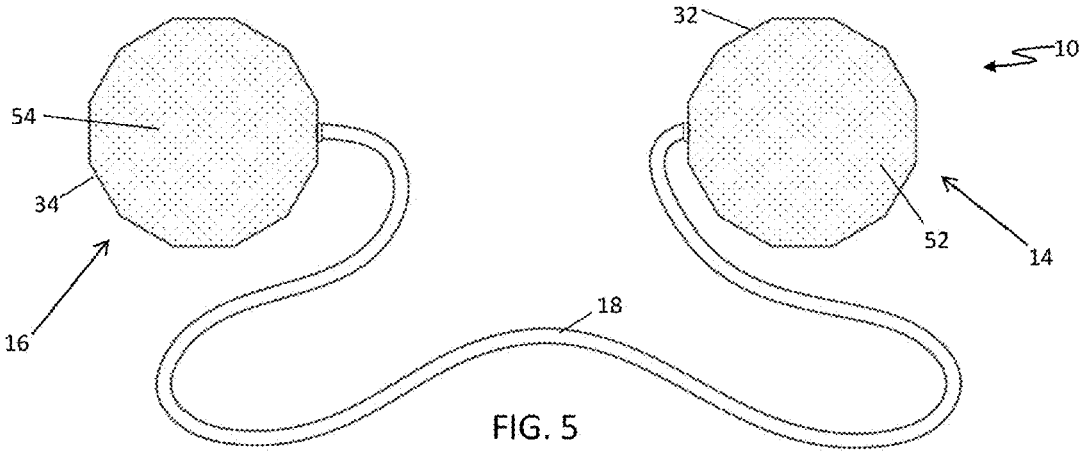
FIG. 5 is bottom view of the headphone assembly of FIG. 1, depicting each earpiece having a perforated proximal wall.

With reference now to FIG. 4, the earpieces 14, 16 each include the body (32, 34) having a 12-sided cross-section as viewed from above. Each body includes a distal wall 36, 38. Each distal wall is generally convex having a large planar central area surrounded by a downwardly angled rim circumscribing the planar area. More particularly, each distal wall includes a downwardly angled rim (40, 42), the single button (22, 24), and a recess (44, 46) circumscribing the button disposed between the button and the rim. Each button preferably accounts for at least 30 percent of the surface area of the distal wall. In the exemplary embodiment, the buttons 22, 24 account for at least 40 percent (e.g., between 40 percent and 50 percent) of the surface area of the distal wall of the body. In this configuration, the button is easily locatable while minimizing the prospects of inadvertent use.

In other embodiments, the size of the button can exceed 50 percent up to 100 percent of the surface area of the distal wall. Having a large single button on each earpiece, sized as discussed herein, enables wearer to operate the system through the liner, even while wearing gloves, even bulky winter gloves, i.e., the button is ease to locate and operate.

The right earpiece 14 includes a charging port disposed below the ports cover 48. In other embodiments, the connecting port can further be provided to transfer digital information, such as software, digital media, and other data, to and from the headphone assembly. Right earpiece further includes an indicator light 50 disposed within the recess 44. The indicator light is used to indicate the operational status and the battery status.

Both earpieces 14, 16 of the headphone assembly 10 include electronic components (not shown) housed within the body's thereof, to include speakers, battery assembly, control circuitry, wireless communication assembly (e.g., a Bluetooth), and related components. In the exemplary embodiment, the right earpiece houses battery assembly and the wireless communications assembly. The wireless communication assembly enables the headphone assembly 10 to communicate with the wireless device 8 enabling the headphone assembly to control the wireless device as well as receive audio media from the wireless device.

With reference now to FIG. 4, the bodies (32, 34) of the earpieces (14, 16), respectively, each include a proximal wall (52, 54). The proximal walls are generally convex having a large planar central area surrounded by a downwardly angled rim circumscribing the planar area. The speaker of each earpiece is housed within the corresponding body proximate to the proximal wall, which is perforated to facilitate acoustics of the headphone assembly, in use.

Figure 6A:
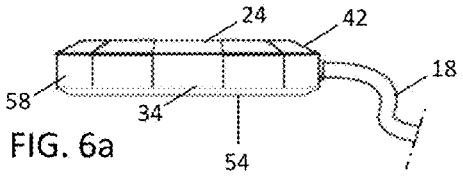
FIGS. 6*a* and 6*b* are side views of the earpieces of the headphone assembly of FIG. 1, depicting the right earpiece having an adjustable cover over ports, such as a charging port, of the headphone assembly.
Figure 6B:
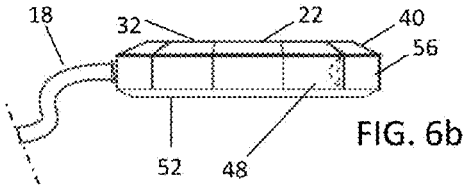
Figure 7A:
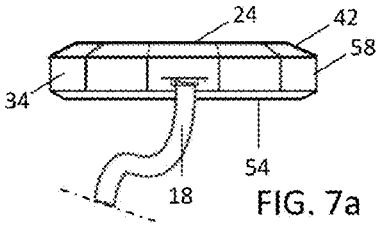
FIGS. 7*a* and 7*b* are back views of the earpieces of the headphone assembly of FIG. 1, depicting connections for a flexible connecting wire extending between the two earpieces.
Figure 7B:
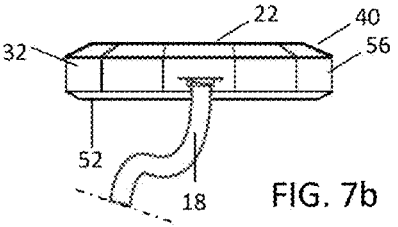

With reference now to FIGS. 6*a, b* and 7*a, b*, the bodies (32, 34) of the earpieces (14, 16), respectively, each include a proximal wall (56, 58). The sidewalls are disposed between the distal wall (36, 38) and the proximal wall (54, 56). Each sidewall comprises twelve flat sections circumscribing the body. In other embodiments, the sidewall can have various other shapes, e.g., multi-sided planar, curved, oval, circular, and so on.

It should be appreciated from the foregoing that the present invention provides a headphone assembly for use with an electronic device, such as mobile phones, mp3 players, and other media devices, adapted to be held in place proximate to a wearer's ears with separate headwear, e.g., sports helmet. The headphone assembly includes two earpieces coupled by a flexible connecting wire. Each earpiece includes a single large button disposed on a distal side of the earpiece. Having a large single button on each earpiece enables wearer to operate the system through a helmet liner, even while wearing gloves, even bulky winter gloves, i.e., the button is ease to locate and operate. In this manner, the wearer can operate the system without direct access to either the headphone assembly or the wireless device.

Although the invention has been disclosed in detail with reference only to the exemplary embodiments, those skilled in the art will appreciate that various other embodiments can be provided without departing from the scope of the invention. Accordingly, the invention is defined only by the claims set forth below.

What is claimed is:

1. A headphone assembly, comprising:

a first earpiece having a distal side and a proximal side, the distal side having a convex shape including a central area surrounded by a downwardly angled rim circumscribing the central area, the first earpiece having a single button positioned on the distal side, the single button sized to account for over 30 percent of the surface area of the distal side;

a second earpiece having a distal side and a proximal side, the distal side having a convex shape including a central area surrounded by a downwardly angled rim circumscribing the central area, the first earpiece having a single button positioned on the distal side, the single button sized to account for over 30 percent of the surface area of the distal side, wherein the first earpiece and the second earpiece both include a sidewall disposed between the distal side and the proximal side, the sidewall having a plurality of planar segments; and a wire extending between the first earpiece and the second earpiece that operatively couples the first earpiece and the second earpiece.

2. The headphone assembly as defined in claim 1, wherein the first and the second earpieces lack over ear attachments or in-ear attachments.

3. The headphone assembly as defined in claim 1, wherein the single button of the first earpiece controls playback of audio and the single button of the second earpiece controls volume.

4. The headphone assembly as defined in claim 1, wherein the distal sides of both earpieces have a convex shape provided by a planar central area surrounded by a downwardly angled rim circumscribing the planar central area.

5. The headphone assembly as defined in claim 4, wherein the single buttons of both earpieces are each disposed on the respective central area.

6. The headphone assembly as defined in claim 4, wherein either the first earpiece or the second earpiece include a wireless communication assembly and a controller to operative with a wireless device.

7. The headphone assembly as defined in claim 1, wherein the single button of each earpiece accounts for over 40 percent of the surface area of the distal side.

8. The headphone assembly as defined in claim 1, wherein the single button of each earpiece accounts for between 40 percent and 50 percent of the surface area of the distal side.

9. A headphone assembly, comprising:

a first earpiece having a distal side and a proximal side, the distal side having a convex shape including a central area surrounded by a downwardly angled rim circumscribing the central area, the first earpiece having a single button positioned in the central area, the single button sized to account for over 30 percent of the surface area of the distal side;

a second earpiece having a distal side and a proximal side, the distal side having a convex shape including a central area surrounded by a downwardly angled rim circumscribing the central area, the first earpiece having a single button positioned in the central area, the single button sized to account for over 30 percent of the surface area of the distal side, wherein the first earpiece and the second earpiece both include a sidewall disposed between the distal side and the proximal side, the sidewall having a plurality of planar segments; and a wire extending between the first earpiece and the second earpiece that operatively couples the first earpiece and the second earpiece, the wire incapable of holding the earpieces in place proximate to the ears of the wearer.

10. The headphone assembly as defined in claim 9, wherein the single button of each earpiece accounts for between 40 percent and 50 percent of the surface area of the distal side.

11. The headphone assembly as defined in claim 9, wherein the first and the second earpieces lack over ear attachments or in-ear attachments.

12. The headphone assembly as defined in claim 9, wherein the single button of the first earpiece controls playback of audio and the single button of the second earpiece controls volume.

13. The headphone assembly as defined in claim 9, wherein either the first earpiece or the second earpiece include a wireless communication assembly and a controller to operative with a wireless device.

14. The headphone assembly as defined in claim 9, wherein the proximal sides of both earpieces have a convex shape provided by a planar central area surrounded by a downwardly angled rim circumscribing the planar central area.

15. A headphone assembly, comprising:

a first earpiece having a distal side and a proximal side, the distal side having a convex shape including a central area surrounded by a downwardly angled rim circumscribing the central area, the first earpiece having a single button positioned in the central area, the single button sized to account for over 30 percent of the surface area of the distal side;

a second earpiece having a distal side and a proximal side, the distal side having a convex shape including a central area surrounded by a downwardly angled rim circumscribing the central area, the first earpiece having a single button positioned in the central area, the single button sized to account for over 30 percent of the surface area of the distal side, wherein the first earpiece and the second earpiece both include a sidewall disposed between the distal side and the proximal side, the sidewall having a plurality of planar segments; and a wire extending between the first earpiece and the second earpiece that operatively couples the first earpiece and the second earpiece, the wire incapable of holding the earpieces in place proximate to the ears of the wearer, wherein the first and the second earpieces lack over ear attachments or in-ear attachments, requiring the earpieces to be held proximate to the ears of a wearer by a separate headwear.

16. The headphone assembly as defined in claim 15, wherein either the first earpiece or the second earpiece include a wireless communication assembly and a controller to operative with a wireless device.

17. The headphone assembly as defined in claim 16, wherein the single button of the first earpiece controls playback of audio and the single button of the second earpiece controls volume.

18. The headphone assembly as defined in claim 17, wherein the single button of each earpiece accounts for between 40 percent and 50 percent of the surface area of the distal side.

* * * * *